US008742278B2

(12) United States Patent
Domejean et al.

(10) Patent No.: US 8,742,278 B2
(45) Date of Patent: Jun. 3, 2014

(54) SWITCHGEAR DEVICE FOR BREAKING A BIDIRECTIONAL DIRECT CURRENT AND INSTALLATION WITH PHOTOVOLTAIC CELLS EQUIPPED WITH SUCH A DEVICE

(75) Inventors: Eric Domejean, Voreppe (FR); Serge Paggi, Ruffey les Echirey (FR)

(73) Assignee: Schneider Electric Industries SAS, Rueil Malmaison (FR)

( * ) Notice: Subject to any disclaimer, the term of this patent is extended or adjusted under 35 U.S.C. 154(b) by 270 days.

(21) Appl. No.: 12/591,192

(22) Filed: Nov. 12, 2009

(65) Prior Publication Data

US 2010/0126966 A1 May 27, 2010

(30) Foreign Application Priority Data

Nov. 21, 2008 (FR) ..... 08 06541

(51) Int. Cl.
*H01H 9/40* (2006.01)

(52) U.S. Cl.
USPC ..... 218/149; 218/152; 335/201

(58) Field of Classification Search
USPC ..... 218/15, 22–26, 34, 43, 44, 149, 218/152–156; 335/201, 202
See application file for complete search history.

(56) References Cited

U.S. PATENT DOCUMENTS

| | | | | |
|---|---|---|---|---|
| 4,764,650 | A * | 8/1988 | Bur et al. | 218/149 |
| 5,004,874 | A | 4/1991 | Theisen et al. | 200/144 R |
| 7,259,646 | B2 * | 8/2007 | Rab et al. | 335/201 |
| 2008/0091580 | A1 * | 4/2008 | Kremen | 705/35 |

FOREIGN PATENT DOCUMENTS

| | | |
|---|---|---|
| DE | 76 02 660 | 7/1976 |
| EP | 1 995 747 | 11/2008 |
| FR | 2 622 736 | 5/1989 |

* cited by examiner

*Primary Examiner* — Amy Cohen Johnson
*Assistant Examiner* — Marina Fishman
(74) *Attorney, Agent, or Firm* — Steptoe & Johnson LLP

(57) ABSTRACT

A switchgear device, for breaking a bidirectional direct current in an electric line, having at least two connection terminals, and an even number of pairs of separable contacts, arc chutes associated with pairs of separable contacts, and tripping mechanisms associated with pairs of separable contacts and connected to one another by a mechanical link, each arc chute having an arc extinguishing chamber and permanent magnets for creating a polarity enabling an electric arc to be removed to an arc extinguishing chamber when current is flowing in the electric line in a predefined direction, the predefined direction being different for one half of the arc chutes.

17 Claims, 10 Drawing Sheets

SWITCHGEAR DEVICE FOR BREAKING A BIDIRECTIONAL DIRECT CURRENT AND INSTALLATION WITH PHOTOVOLTAIC CELLS EQUIPPED WITH SUCH A DEVICE

BACKGROUND OF THE INVENTION

The invention relates to the field of switchgear devices, in particular to devices for breaking bidirectional direct currents, in particular low-intensity direct currents, i.e. currents having an intensity ranging from 0.5 to 150 Amps.

The invention relates to a switchgear device for breaking in particular a direct current in at least one electric line whatever the direction of flow of said current in said line, said device comprising:

at least two connection terminals, a predefined even number of separable contacts comprising two contacts electrically connected to said connection terminals, a number of arc chutes equal to said predefined even number, each arc chute being associated with a distinct pair of separable contacts, each arc chute being provided with an arc formation chamber, an arc extinguishing chamber and permanent magnets presenting a polarity enabling an electric arc to be removed to said arc extinguishing chamber when the current in the at least one electric line is flowing in a predefined direction, said predefined current flow direction being different for a part of the arc chutes.

The invention also relates to an installation with photovoltaic cells equipped with such a switchgear device.

STATE OF THE ART

U.S. Pat. No. 5,004,874 describes a switching apparatus designed to be connected on an electric line wherein a bidirectional direct current is flowing, said apparatus comprising two pairs of separable contacts including a stationary contact and a movable contact for each pair, the movable contacts being securedly mounted on one and the same conducting support to form a single contact bridge. This switching apparatus further comprises two arc chutes and two connection terminals electrically connected to the stationary contacts. This switching apparatus enables the contact bridge to be opened, removing an electric arc formed between one or the other of the pairs of separable contacts to the arc chute associated with said pair of contacts according to the direction of flow of the current in the electric line.

The switching apparatus described in this patent does not comprise any tripping means enabling the contact bridge to be opened in the event of an electrical fault. Furthermore, one shortcoming of this switching apparatus is that it only enables connection on a single electric line and does not enable the number of arc chutes to be easily adapted and optimized according to the voltage at the terminals of said apparatus. Another shortcoming of this switching apparatus is that it is bulky.

SUMMARY OF THE INVENTION

The object of the invention is to remedy the limitations and shortcomings of switchgear devices of the prior art by proposing a switchgear device for breaking in particular a direct current in at least one electric line whatever the direction of flow of said current in said line, said device comprising:

at least two connection terminals, a predefined even number of separable contacts comprising two contacts electrically connected to said connection terminals, a number of arc chutes equal to said predefined even number, each arc chute being associated with a distinct pair of separable contacts, each arc chute being provided with an arc formation chamber, an arc extinguishing chamber and permanent magnets presenting a polarity enabling an electric arc to be removed to said arc extinguishing chamber when the current in the at least one electric line is flowing in a predefined direction, said predefined current flow direction being different for a part of the arc chutes.

Said device is characterized in that it comprises a number of tripping mechanisms equal to said predefined even number, each tripping mechanism being associated with one of said pairs of separable contacts to separate the separable contacts of said pair in response to an electric fault in the at least one electric line, said tripping mechanisms being connected to one another by a mechanical link enabling said pairs of separable contacts to be opened simultaneously.

The predefined direction of the current flow is preferably different for one half of the arc chutes.

The arc extinguishing chamber of each arc chute is preferably formed by a stack of deionizing plates.

The switchgear device is preferably of the modular type and comprises a number of modules equal to said predefined even number, each module comprising:

one of said pairs of separable contacts, the arc chute associated with said pair of separable contacts, the tripping mechanism associated with said pair of separable contacts, and a feeder terminal and an incomer terminal electrically connected respectively to one and to the other of said separable contacts.

Each module is preferably housed in a case comprising two parallel main panels, said modules being adjoined to one another via their main panels. Each pair of separable contacts advantageously comprises a movable contact able to move along an axis substantially parallel to the main panels. The movable contacts of each pair of separable contacts are preferably all arranged on the same side of said device.

The arc formation chamber of each arc chute is preferably delineated by a first and a second cheek extending in a direction parallel to the main panels of the modules, the permanent magnets of said arc chute being arranged behind at least the first cheek and presenting a polarity enabling a magnetic field to be generated oriented in a direction substantially perpendicular to said main panels. The arc formation chamber of each arc chute advantageously comprises:

an enhanced-induction section comprising a first part of the permanent magnets of said arc chute generating a magnetic field enabling the electric arc to be propelled, the first part of the permanent magnets comprising two magnetized fractions arranged behind each of the cheeks, and a diverting section comprising a second part of said permanent magnets generating a magnetic field, along a longitudinal axis, that is substantially weaker than the field generated by the first part of the permanent magnets and enabling the electric arc to be diverted with respect to the longitudinal axis.

According to one embodiment, the switchgear device is dedicated to breaking on a single electric line, the connection terminals comprising a first feeder terminal and a first incomer terminal designed to be connected in series on said electric line.

The switchgear device preferably comprises at least two modules, the first feeder terminal is the feeder terminal of a first module and the first incomer terminal is the incomer terminal of a second module, the incomer terminal of the first module being connected to the feeder terminal of the second module. Advantageously, the first feeder terminal and the first incomer terminal are arranged on the same side, and the permanent magnets of the arc chutes in the first and second module present identical polarities to generate magnetic fields oriented in the same direction.

Alternatively, the switchgear device comprises four modules, the incomer terminal of the first module being connected to the feeder terminal of a third module, the incomer terminal of said third module being connected to the feeder terminal of a fourth module, the incomer terminal of said fourth module being connected to the feeder terminal of the second module.

According to another embodiment, the switchgear device is dedicated to breaking on two electric lines, and the connection terminals comprise a first feeder terminal and a first incomer terminal designed to be connected in series on one of said lines, and a second feeder terminal and a second incomer terminal designed to be connected in series on the other of said lines.

The device preferably comprises two modules only, the first feeder terminal and the first incomer terminal being the feeder and incomer terminals of a first module, the second feeder terminal and the second incomer terminal being the feeder and incomer terminals of a second module.

Alternatively, the device comprises four modules combining two switchgear devices dedicated to breaking on a single electric line, the first feeder terminal and the first incomer terminal of one of said devices corresponding respectively to the second feeder terminal and the second incomer terminal.

The modules are preferably indissociable.

The invention also relates to an installation with photovoltaic cells comprising at least one panel whereon said cells are arranged, said panel being connected to two electric lines designed to supply electric power in the form of direct current, the installation being characterized in that it comprises at least one switchgear device as described above comprising at least two connection terminals connected on said at least one electric line.

DETAILED DESCRIPTION OF AN EMBODIMENT

Figure 1:
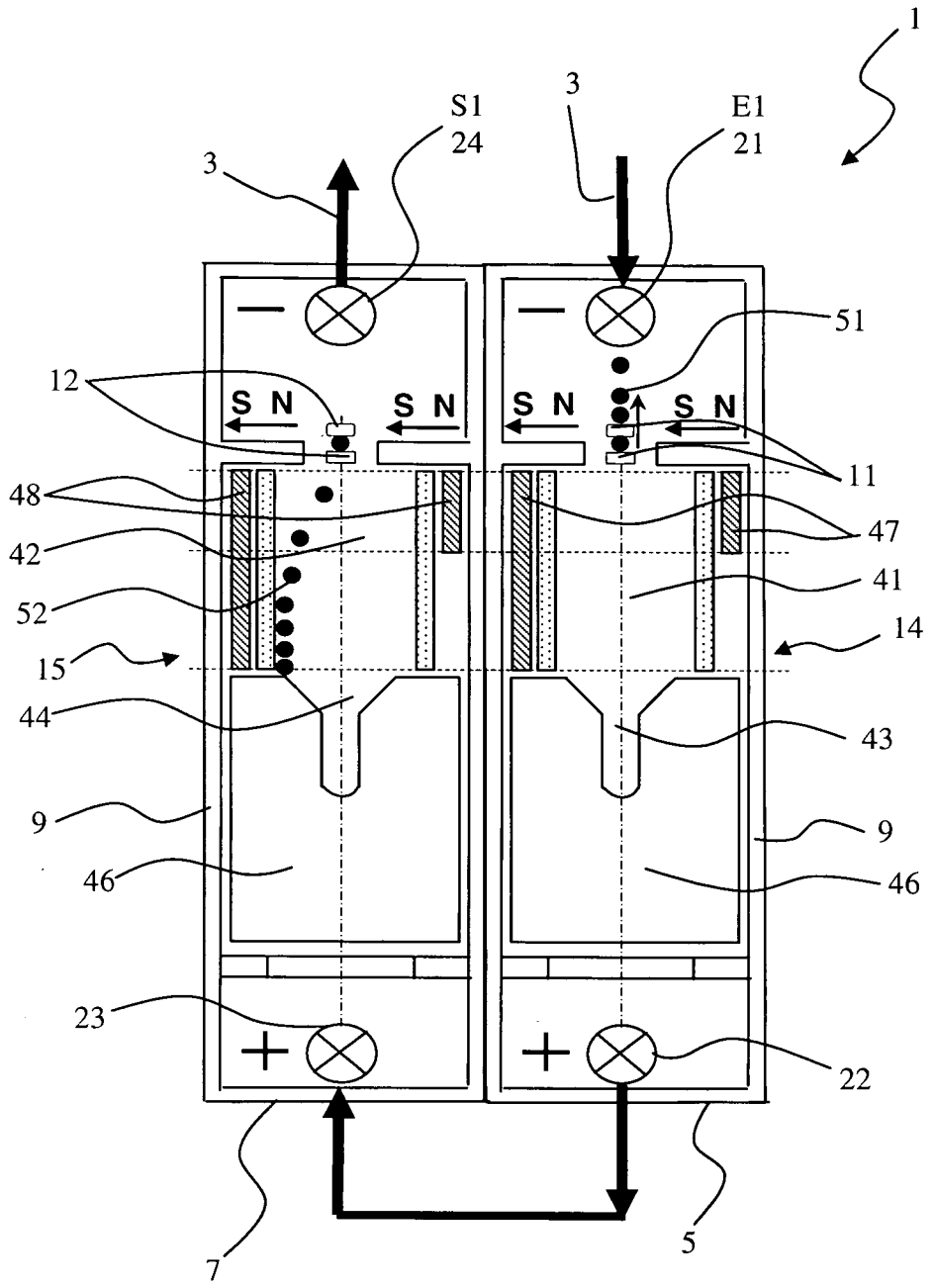
FIG. 1 is a simplified longitudinal cross-section of a modular switchgear device according to the invention enabling series mounting on a single electric line.

With reference to FIG. 1, switchgear device 1 is mounted in series on an electric line 3 which is connected by means of connection terminals E1 and S1. Switchgear device 1 comprises two pole-units referred to as first module 5 and second module 7 on account of the substantially identical sizes of their respective cases. These modules are adjoined to one another in indissociable manner via their main panels 9. Each module 5, 7 comprises a pair of separable contacts 11, 12, an arc chute 14, 15, and a tripping mechanism. Each module 5, 7 further comprises a feeder terminal 21, 23 and an incomer terminal 22, 24, said terminals being electrically connected to one and to the other of said separable contacts. Feeder terminal 21 of first module 5 and incomer terminal 24 of second module 7 correspond to the connection terminals respectively referenced E1 and S1.

Figure 2:
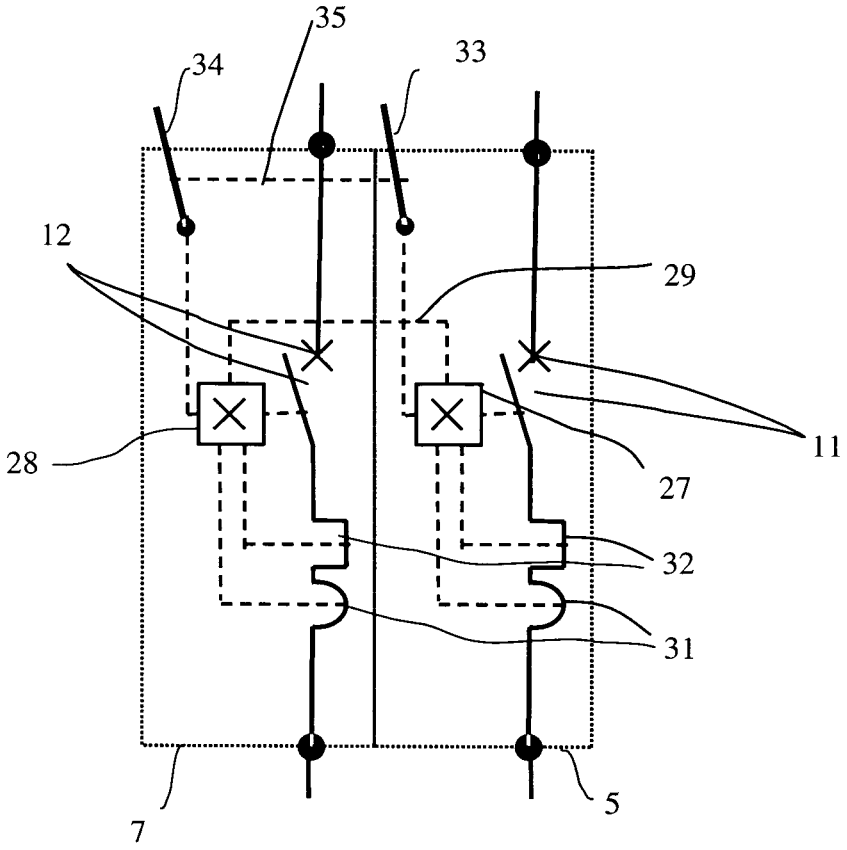
FIG. 2 schematically represents the tripping and switching mechanisms of the switchgear device represented in FIG. 1.

As can be seen in FIG. 2, tripping mechanisms 27, 28 of each module 5, 7 are connected to one another by a mechanical link 29, which enables all the pairs 11, 12 of separable contacts to be opened simultaneously following the occurrence of an electric fault on electric line 3. The tripping mechanism of each module generally comprises thermal tripping means 31 and magnetic tripping means 32. Each module 5, 7 of the switchgear device can further comprise a handle 33, 34 enabling the separable contacts to be opened or closed manually. These handles are generally connected to one another by a bar 35 enabling all the pairs 11, 12 of separable contacts to be opened or closed simultaneously. In this way, switchgear device 1 presents a circuit breaker function and a switch function.

In switchgear device 1 represented in FIGS. 1 and 2, each arc chute 14, 15 and each tripping mechanism 27, 28 of one and the same module 5, 7 is associated with the pair 11, 12 of separable contacts of this module. The pairs of separable contacts are moreover disunited, i.e. there is no direct mechanical link between the contacts of each of said pairs. Mechanical links 29, 35 between tripping mechanisms 27, 28 and between handles 33, 34 are not in fact able to form a securedly attached direct mechanical link between the contacts of different pairs of separable contacts. In other words, the contacts of different pairs of separable contacts are not securedly attached to an intermediate part such as a contact bridge for example. Due to this configuration, each pair of separable contacts and the arc chute associated with said pair of separable contacts can operate in independent manner. Direct currents can thus be broken under different voltages using a switchgear device wherein the number of arc chutes is adapted to said voltage in the line to be protected. Furthermore, as described further on, the independence between the pairs of separable contacts enables the switchgear device to be connected in series on two electric lines of opposite polarities.

As can be seen in FIG. 1, arc chute 14, 15 of each module 5, 7 comprises an arc formation chamber 41, 42, and an arc extinguishing chamber 43, 44, in the majority of cases formed by a stack of deionizing plates 46. Arc chute 14, 15 of each module 5, 7 further comprises permanent magnets 47, 48. When opening of pairs 11, 12 of separable contacts takes place, an electric arc is generated between each of said pairs of separable contacts.

Permanent magnets 47, 48 of each arc chute 14, 15 present a polarity enabling the electric arc to be removed to arc extinguishing chamber 43, 44 of said arc chute when the current in electric line 3 flows in a predefined direction. This predefined current flow direction is proper to the arc chute considered. Thus, if the current of the electric line flows in the opposite direction to the predefined current flow direction, the electric arc of the arc chute considered is removed to the outside of the arc extinguishing chamber. As explained further on, this predefined current flow direction can vary from one arc chute to the other. This predefined current flow direction is determined on the one hand by the polarity of the permanent magnets of the arc chute considered and on the other hand by the connections of the feeder and incomer terminals of the module housing said considered arc chute.

More precisely, the magnetic field generated by the permanent magnets on the one hand and the electric current in the electric arc formed between the separable contacts when said contacts open on the other hand, enable forces to be generated that will propel the electric arc in one direction or the other. This arc removal direction depends essentially on the direction of the current in the electric arc and on the polarity of the permanent magnets. Thus, for a given polarity of the permanent magnets, the electric arc is removed to the arc extinguishing chamber or to outside this arc extinguishing chamber depending on the direction of the current in the electric arc, i.e. depending on the direction of the current flow in electric line 3.

According to one feature of the invention, the switchgear device comprises an even number Np of arc chutes and the predefined current flow direction is different for a part, in this instance one half, of said arc chutes. In this way, whatever the direction of current flow in the electric line, a first half of the arc chutes remove the electric arcs to their respective arc extinguishing chambers, and a second half of the arc chutes remove the electric arcs to outside their respective arc extinguishing chambers.

Figure 3:
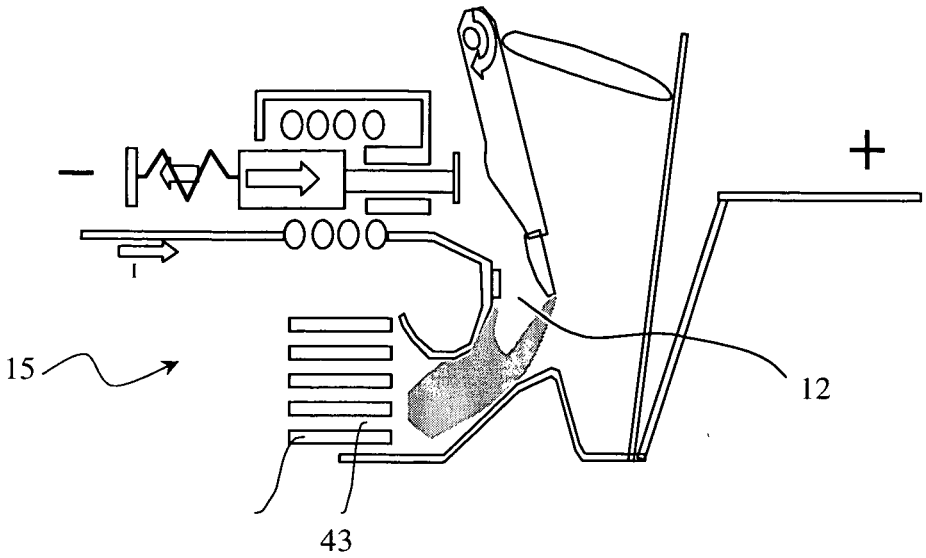
FIG. 3 is a diagram illustrating removal of an electric arc to the extinguishing chamber of an arc chute.
Figure 4:
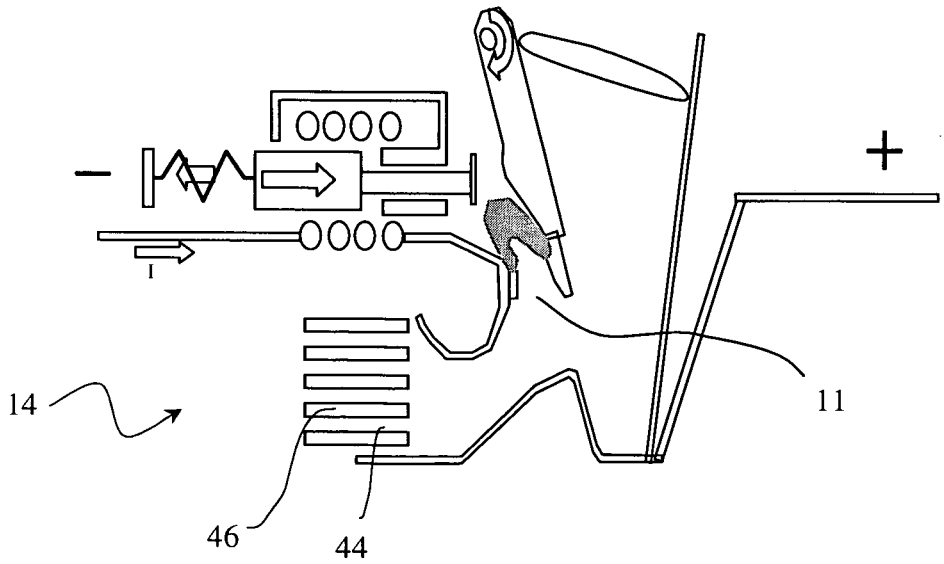
FIG. 4 is a similar diagram to that of FIG. 2 illustrating removal of an electric arc from the extinguishing chamber.

In the embodiment represented in FIG. 1, opening of the two pairs of separable contacts generates two electric arcs 51, 52. Electric arc 51 in arc chute 14 is removed outside arc extinguishing chamber 43 of this arc chute, whereas electric arc 52 in arc chute 15 is removed to arc extinguishing chamber 44. The opposite would be the case if the current in electric line 3 was reversed. Arc chute 15 of second module 7 and arc chute 14 of first module 5, and their respective electric arcs 51, 52, are also represented schematically in another longitudinal plane respectively in FIG. 3 and in FIG. 4.

In the embodiment represented in FIG. 1, first feeder terminal E1 and first incomer terminal S1 are arranged on the same side, and permanent magnets 47, 48 of arc chutes 14, 15 in first and second module 5, 7 present identical polarities so as to generate magnetic fields oriented in the same direction. In this way, in arc chute 14, the direction of the current in electric arc 51 enables this arc to be removed to outside arc extinguishing chamber 43. At the same time, in arc chute 15, the direction of the current in electric arc 52 enables this arc to be removed to arc extinguishing chamber 44. Thus, the direction of the current flowing in electric line 3 corresponds to the predefined current flow direction associated with arc chute 15 for which the electric arc is removed to the arc extinguishing chamber.

In another embodiment, not represented, the first feeder terminal and the first incomer terminal could be arranged on two opposite sides, in which case the permanent magnets of the arc chutes in the first and second module should present opposite polarities so as to generate magnetic fields oriented in an opposite direction.

Arc chutes 14, 15 used in switchgear device 1 present an architecture that is generally specific to breaking mono-directional direct current, and it is the association of an even number of these arc chutes that enables bi-directional direct currents to be broken. This specific architecture of the arc chutes is described further on with reference to FIGS. 5 and 6. Association of these arc chutes has been made possible partly due to their good intrinsic performances, in particular in terms of growth rate of the voltage of the electric arc removed to the arc extinguishing chamber. In this way, electric arc 52 of arc chute 15, which is removed to arc extinguishing chamber 44, absorbs most of the voltage compared with electric arc 51 of arc chute 14 which is removed to outside extinguishing chamber 43. This in particular enables the negative effects of removing an electric arc to outside the arc extinguishing chamber to be reduced or even annulled. To minimize the voltage of the electric arc dissipated in each arc chute, it is possible to multiply the number of arc chutes as described further on with reference to FIGS. 8 and 9.

It is also possible to over-dimension the arc chutes with respect to the requirements of breaking a mono-directional current for which the electric arc is systematically removed to the arc extinguishing chamber. In spite of this over-dimensioning, the switchgear device remains very compact and less bulky compared with devices of the prior art.

The arc chutes of the switchgear devices generally present an architecture specific to breaking of mono-directional direct currents. The arc chute represented in FIGS. 5 and 6 is particularly suited to the switchgear device according to the invention.

Figure 5:
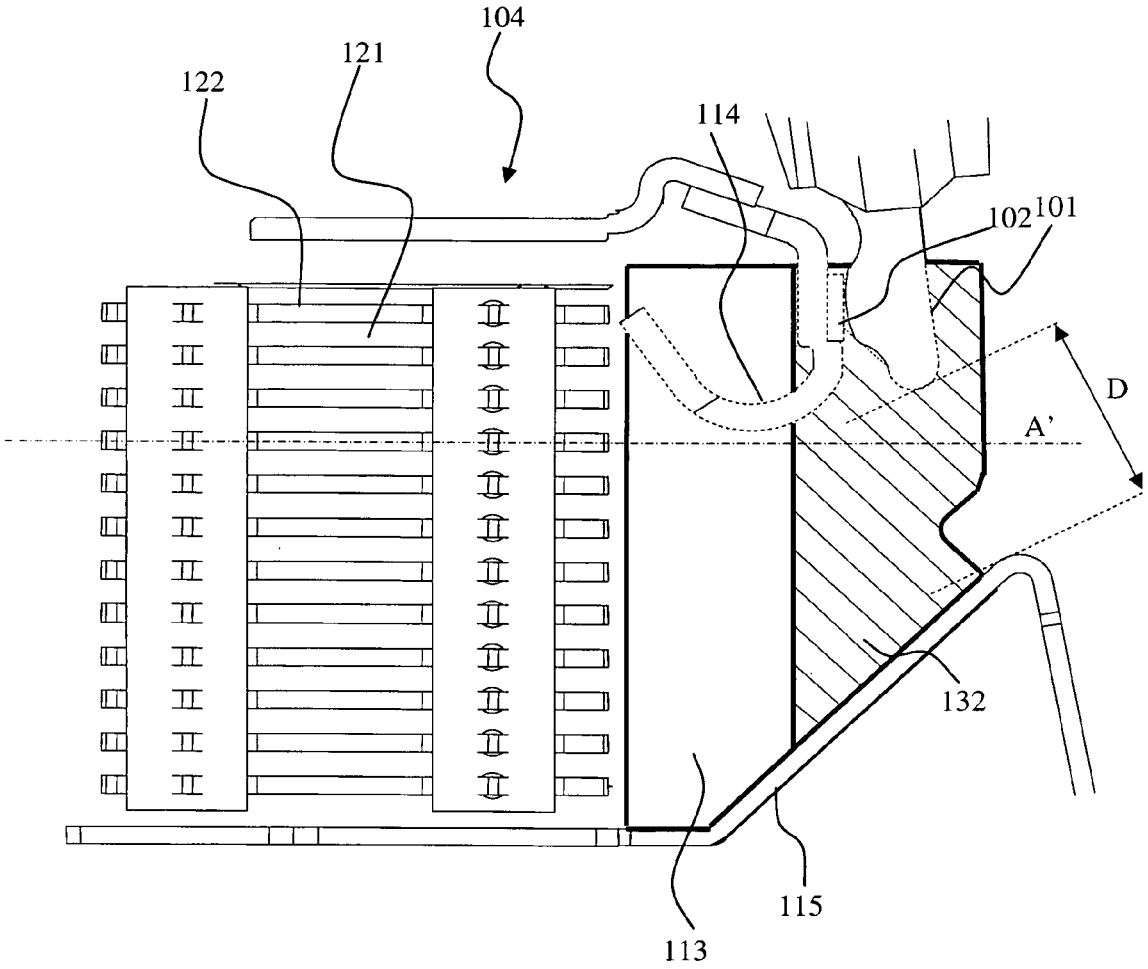
FIG. 5 is a partial view of a switchgear device module according to the invention.
Figure 6:
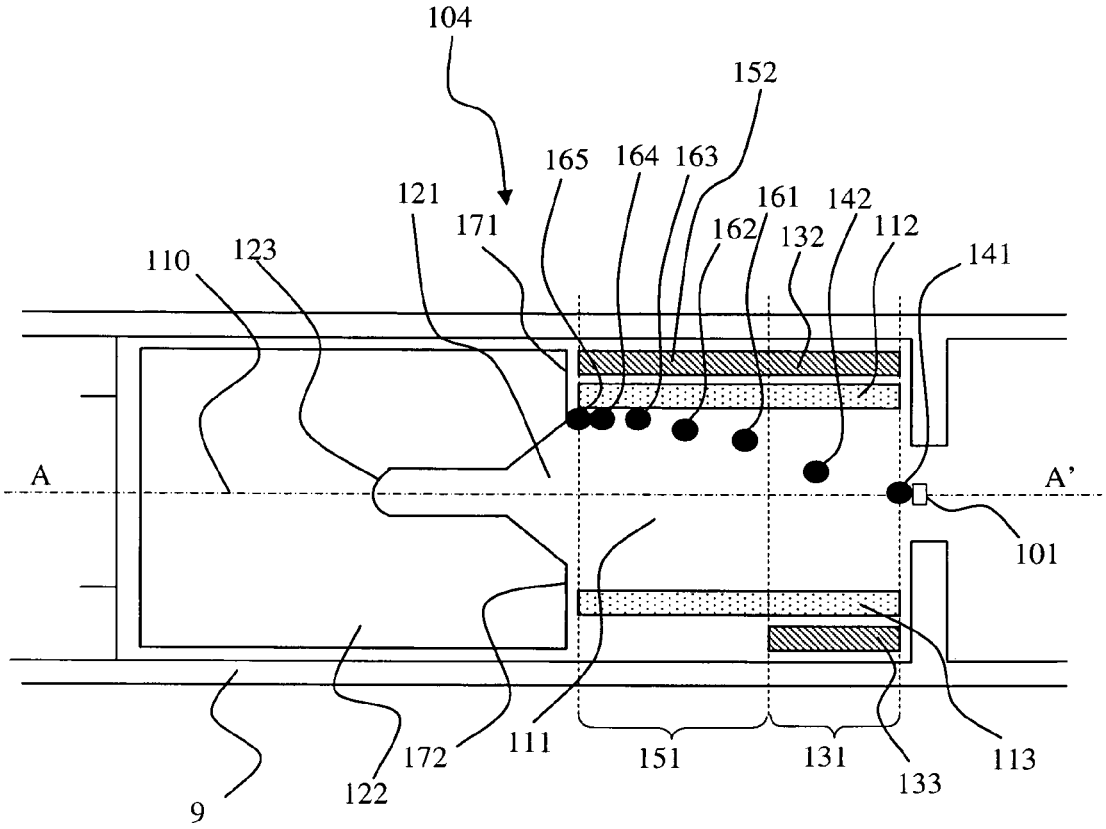
FIG. 6 is a simplified longitudinal cross-section of the module represented in FIG. 4 along a cross-sectional line A-A'.

With reference to FIGS. 5 and 6, each of these arc chutes houses a pair of separable contacts comprising a movable contact 101 and a stationary contact 102. Arc formation chamber 111 of arc chute 104 is delineated by a first cheek 112 and a second cheek 113, said cheeks being substantially parallel to main panels 9. One of the feeder or incomer terminals of the module comprising arc chute 104 is for its part electrically connected to stationary contact 102 and is extended to form an arcing electrode or horn 114 that extends in the top part of the arc formation chamber. The other terminal of the module comprising arc chute 104 is electrically connected to movable contact 101 and is connected to another arcing electrode or horn 115 that extends in the bottom part of the arc formation chamber. Arcing electrodes or horns 114 and 115 are arranged in such a way as to pick up an electric arc drawn between contacts 101 and 102 when the latter separate. The electric arc formed between the two contacts is thereby picked up by the electrodes to be transported and removed to arc extinguishing chamber 121 of the arc chute, provided that the current in the electric line is in the predefined direction.

It should be noted that, in FIG. 5, separable contacts 101 and 102 and electrode 114 have been represented in broken lines due to the fact that they are hidden in particular by second cheek 113. The distance between movable contact 101 and electrode 115 in the bottom part of the arc formation chamber is generally comprised between 4 and 8 millimeters.

This distance enables good performances to be obtained for breaking high-intensity currents.

In arc chute 104 represented in FIGS. 5 and 6, arc extinguishing chamber 121 is formed by a stack of deionizing plates 122 which are generally metal plates. The deionizing plates comprise a leading edge via which the electric arc enters the extinguishing chamber. The leading edge of the deionizing plates generally comprises a central depression 123.

In arc chute 104 represented in FIGS. 5 and 6, arc formation chamber 111 comprises an enhanced-induction section 131 wherein the arc is propelled towards arc extinguishing chamber 121 by the magnetic field generated by a first part of the permanent magnets. The magnetic field generated along a longitudinal axis 110 of the arc formation chamber by the first part of the permanent magnets in the enhanced-induction section is greater than that generated by the other part of the permanent magnets in the rest of the arc formation chamber. This configuration enables the electric arc to be better propelled and to make the latter leave the separable contacts. Switching of the electric arc root between the movable contact and electrode 115 is thus mainly obtained by means of the first part of the permanent magnets in the enhanced-induction section of the arc formation chamber.

As can be seen in FIG. 6, movement of the electric arc is represented by points at different times. In the enhanced-induction section, the electric arc is represented by points 141 and 142.

In arc chute 104 represented in FIGS. 5 and 6, the first part of the permanent magnets comprises not only a first magnetized fraction 132 but also a second magnetized fraction 133. Magnetized fractions 132 and 133 are arranged behind each of cheeks 112 and 113. What is meant by magnetized fraction of the first part of the permanent magnets is a fraction defined with respect to said first part of the permanent magnets, i.e. with respect to the part of the permanent magnets in the enhanced-induction section. The presence of second magnetized fraction 133 of the first part of the permanent magnets generates a magnetic field that is added to the field generated by first magnetized fraction 132. This enables the magnetic force induced by the first part of the permanent magnets on the electric arc to be significantly increased. Second magnetized fraction 133 of the first part of the permanent magnets thereby enables the electric arc root to be switched between movable contact 101 and electrode 115, as well as enabling said electric arc to depart and be removed to the extinguishing chamber. The effect of the distance D between movable contact 101 and electrode 115 is therefore compensated by the presence of second magnetized fraction 133.

In arc chute 104 represented in FIGS. 5 and 6, first and second magnetized fraction 132 and 133 of the first part of the permanent magnets generate magnetic fields of substantially equal intensity. The magnetic force to propel the electric arc in the direction of extinguishing chamber 121 has thus been doubled, which enables the electric arc to be propelled to the extinguishing chamber more rapidly. Furthermore, first and second magnetized fraction 132 and 133 of the first part of the permanent magnets are arranged symmetrically with respect to longitudinal axis 110 of the arc formation chamber. This enables the properties described above, i.e. propelling the electric arc to the extinguishing chamber more efficiently, to be enhanced even further.

In arc chute 104 represented in FIGS. 5 and 6, arc formation chamber 111 comprises a diverting section 151 in which the electric arc is diverted with respect to a longitudinal axis 110 of the arc formation chamber to first cheek 112 by the magnetic field generated by a second part of the permanent magnets, the magnetic field generated by the second part of the permanent magnets being substantially weaker than the field generated by the first part of the permanent magnets. Due to the fact that the magnetic field on longitudinal axis 110 generated by the second part of the permanent magnets is weaker than that of the first part of the permanent magnets and is not symmetrical with respect said longitudinal axis, the electric arc is diverted from its path. The diverting component of the electric arc is thus mainly obtained by means of the second part of the permanent magnets in diverting section 151.

In arc chute 104 represented in FIGS. 5 and 6, the whole of second part 152 of the permanent magnets is arranged behind first cheek 112. In other embodiments that are not represented, only a fraction of the second part of the permanent magnets can be arranged behind the first cheek, so that the magnetic field generated by said fraction is stronger than that generated by the remaining fraction of the second part of the permanent magnets, the latter being arranged behind second cheek 113. What is meant by magnetized fraction of the second part of the permanent magnets is a fraction defined with respect to the part of the permanent magnets in the diverting section.

As can be seen in FIG. 6, in diverting section 151, points 161, 162, 163, 164 and 165 represent the positions of the electric arc in the diverting section at different moments. These points move towards first cheek 112 due to the fact that second part 152 of the permanent magnets enables the electric arc to be diverted. In this way, the electric arc moves towards first cheek 112 while at the same time keeping a sufficient magnetic force along longitudinal axis 110 so as not to stick on the latter and to collapse in contact therewith.

As can be seen in FIG. 6, the leading edge of the deionizing plates is equipped with a central depression 123 and with two lateral parts 171 and 172 facing diverting section 151 of the arc formation chamber. When the current in the electric line is in the predefined direction, the electric arc is directed in the diverting section towards lateral part 171. Thus, in the case of breaking of a low-intensity current, the electric arc can be extinguished on lateral part 171 of the leading edge of arc extinguishing chamber 121 due to the small amount of energy to be dissipated.

In arc chute 104 represented in FIGS. 5 and 6, the distance between second part 152 of the permanent magnets and lateral part 171 of the deionizing plates is advantageously less than 1 millimeter. This distance is sufficiently small to prevent this electric arc from coming and extinguishing in the arc formation chamber. Furthermore, cheeks 112 and 113 delineating the arc formation chamber are generally formed from an electrically insulating material. To obtain a good electrical endurance with low-intensity direct currents, with relatively long breaking times compared with alternating currents, the cheeks can be formed from an electrically insulating material which does not erode easily, such as ceramic, for example steatite. To obtain good breaking with high-intensity direct or alternating currents, the cheeks can be formed from a gas-generating electrically insulating material, for example gas-generating nylon. Advantageously, first cheek 112 is made from ceramic material and second cheek 13 is made from a gas-generating organic material. The gas-generating cheek enables the pressure in the contact zone to be increased and thereby enhances departure of the electric arc from the contact zone to the arc extinguishing chamber.

In arc chute 104 represented in FIGS. 5 and 6, the arc chute comprises a first and second permanent magnet respectively arranged behind each of cheeks 112 and 113. The magnet arranged behind first cheek 112 extends over both the enhanced-induction section and the diverting section of the arc formation chamber, and the magnet arranged behind second cheek 113 extends only over the enhanced-induction section. In this case, the first part of the permanent magnets of the enhanced-induction section is essentially formed by the first magnet, i.e. magnetized fraction 132, and by the fraction of the second magnet in the enhanced-induction section, i.e. magnetized fraction 133. In the same way, the second part of the permanent magnets of the diverting section is essentially formed by the fraction of the second magnet in the diverting section, i.e. magnetized fraction 152.

The arc chute could comprise two permanent magnets arranged behind the first cheek respectively in the enhanced-induction section and in the diverting section, the magnet in the enhanced-induction section generating a magnetic field of substantially greater intensity than that in the diverting section. The arc chute could comprise three permanent magnets, a first and second magnet being arranged behind the first cheek respectively in the enhanced-induction section and in the diverting section, and a third magnet being arranged behind the second cheek in the enhanced-induction section.

By integrating the arc chutes represented in FIGS. 5 and 6 in the switchgear device according to the invention, the performances in terms of increase of the arcing voltage in the arc chute removing the electric arc to the arc extinguishing chamber are improved. This enables the arcing voltage in the other arc chute in which the electric arc is removed outside the arc extinguishing chamber to be minimized.

The embodiment of the switchgear device represented in FIG. 1 is suitable for an assembly comprising two electric lines one of which is earthed. In this type of assembly, the switchgear device simply has to be connected in series on the line that is not earthed.

In the case of an isolated power system, i.e. a system comprising two electric lines having reverse polarities, it is possible to use a single switchgear device connected in series on the two lines. An embodiment of a switchgear device enabling such a connection is represented in FIG. 7.

Figure 7:
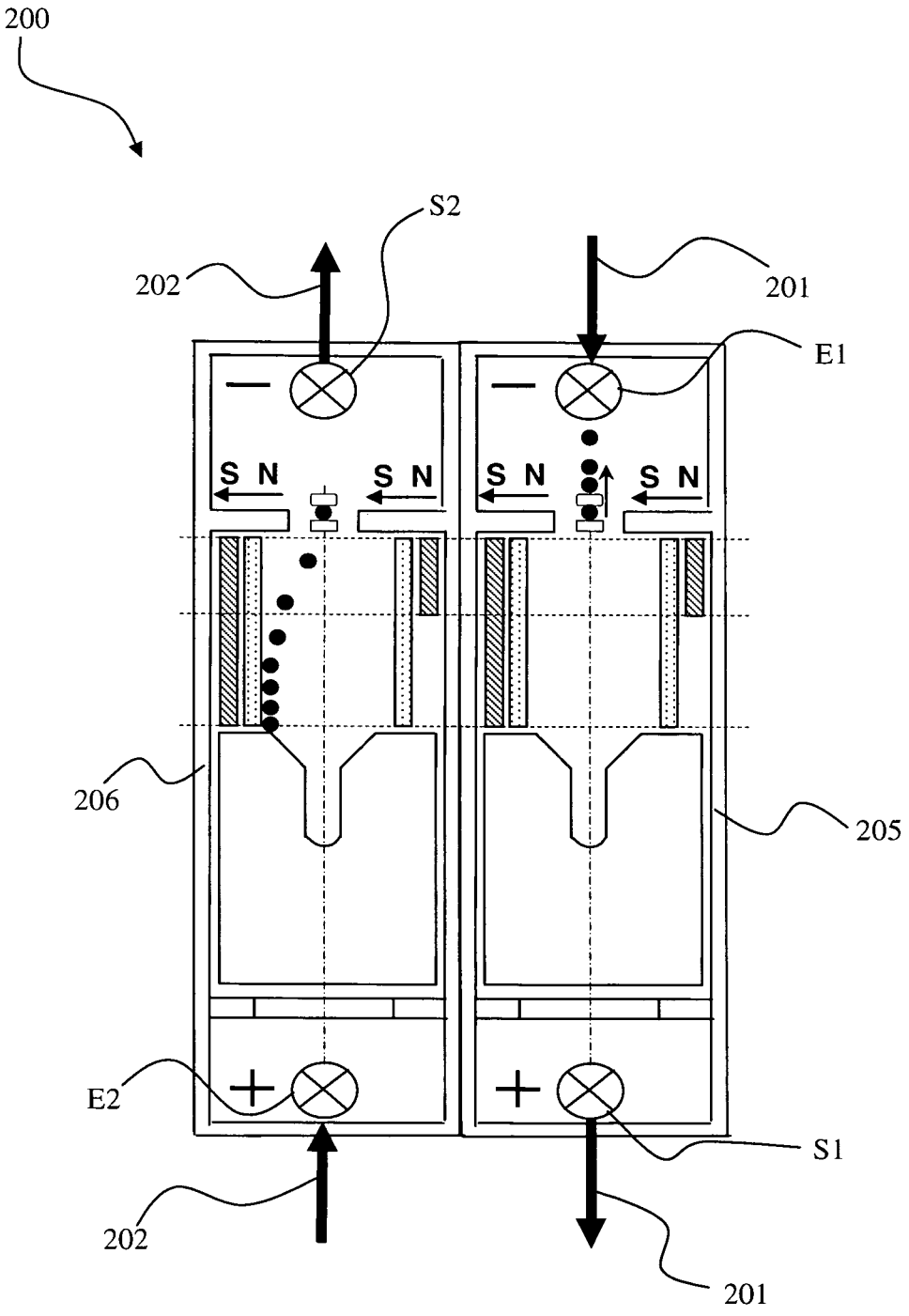
FIG. 7 is a simplified longitudinal cross-section of a device according to one embodiment comprising two pole-units and suitable for mounting in series on two electric lines of opposite polarities.

With reference to FIG. 7, the connection terminals comprise a first feeder terminal E1 and a first incomer terminal S1 designed to be connected in series on line 201, and a second feeder terminal E2 and a second incomer terminal S2 designed to be connected in series on line 202. Switchgear device 200 comprises two modules 205, 206 only, first feeder terminal E1 and first incomer terminal S1 being the feeder and incomer terminals of a first module 205, second feeder terminal E2 and second incomer terminal S2 being the feeder and incomer terminals of a second module 206.

Figure 8:
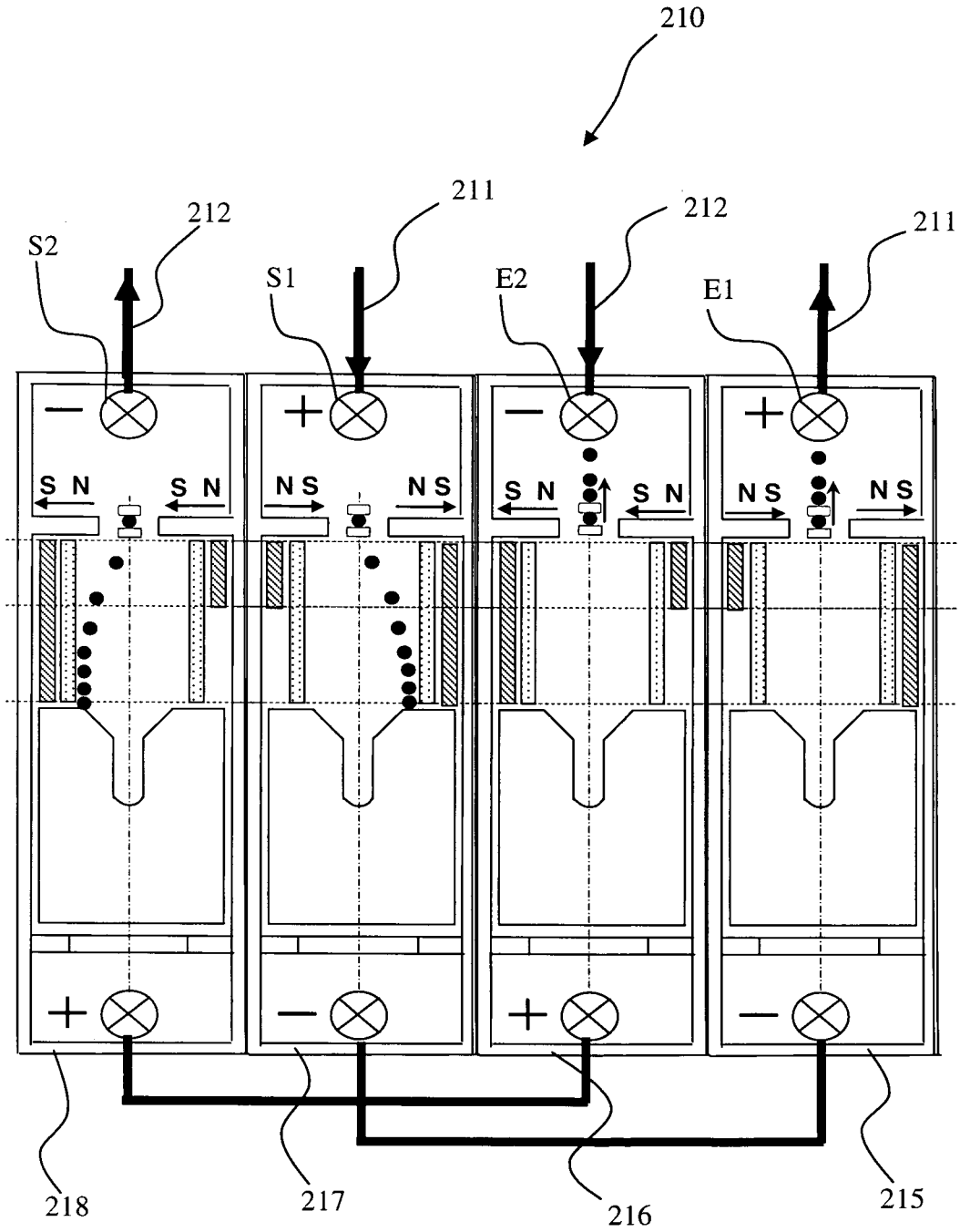
FIG. 8 is a simplified longitudinal cross-section of a device according to another embodiment comprising four pole-units and suitable for mounting in series on two electric lines of opposite polarities.
Figure 9:
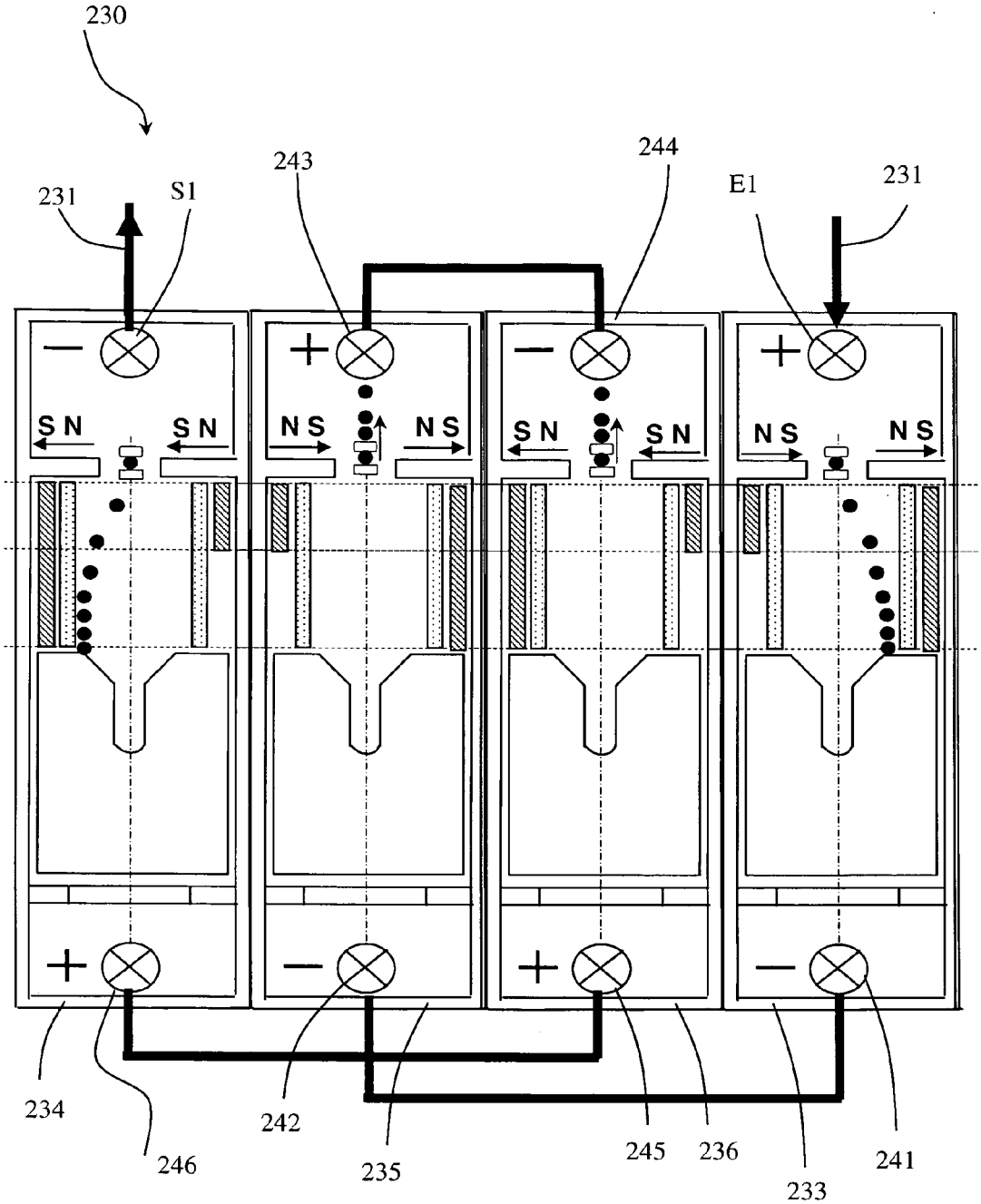
FIG. 9 is a simplified longitudinal cross-section of a device according to yet another embodiment comprising four pole-units and suitable for mounting on a single electric line.

To minimize the voltage of the electric arc dissipated in each arc chute, the number of arc chutes can be multiplied as described further on with reference to FIGS. 8 and 9.

In the embodiment represented in FIG. 8, switchgear device 210 is dedicated to breaking on two electric lines 211, 212 and comprises four modules 215, 216, 217, 218. Switchgear device 210 in fact combines a first and a second switchgear device of the same type as represented in FIG. 7, the first device comprising modules 215 and 217 and the second device comprising modules 216 and 218.

In the embodiment represented in FIG. 9, switchgear device 230 is dedicated to breaking on a single electric line 231 and comprises four modules. The connection terminals comprise a first feeder terminal E1 and a first incomer terminal S1 designed to be connected in series on said electric line 231. Switchgear device 230 comprises a first, second, third and fourth module respectively referenced 233, 234, 235, 236. First feeder terminal E1 is the feeder terminal of a first module 233 and first incomer terminal S1 is the incomer terminal of a second module 234, the incomer terminal of the first module being connected indirectly to the feeder terminal of the second module. More precisely, incomer terminal 241 of first module 233 is connected to feeder terminal 242 of third module 235, incomer terminal 243 of said third module being connected to feeder terminal 244 of fourth module 236, incomer terminal 245 of said fourth module being connected to feeder terminal 246 of the second module.

Figure 10:
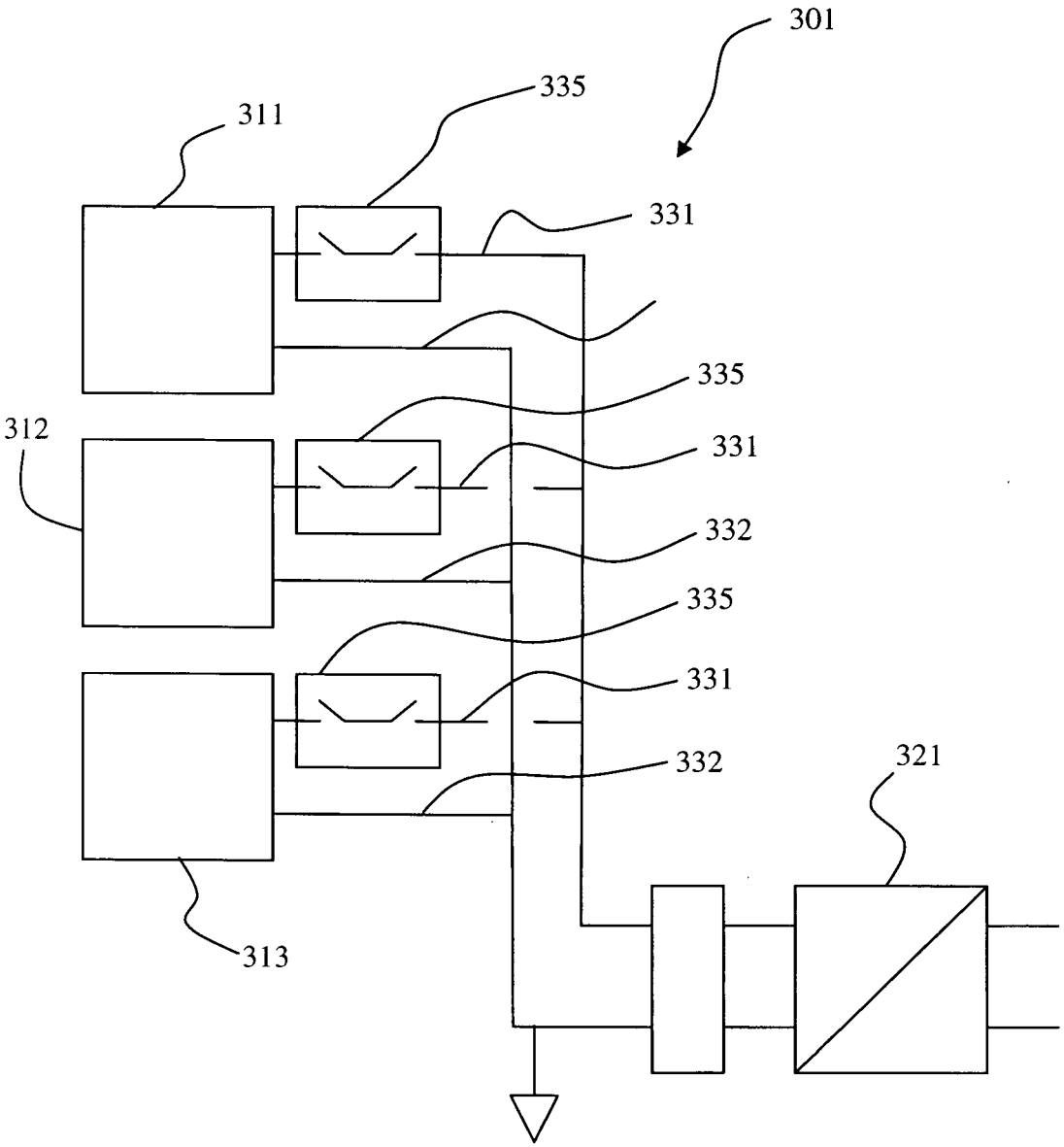
FIG. 10 represents an example of use of switchgear devices suitable for mounting in series on a single electric line in an installation with photovoltaic cells.
Figure 11:
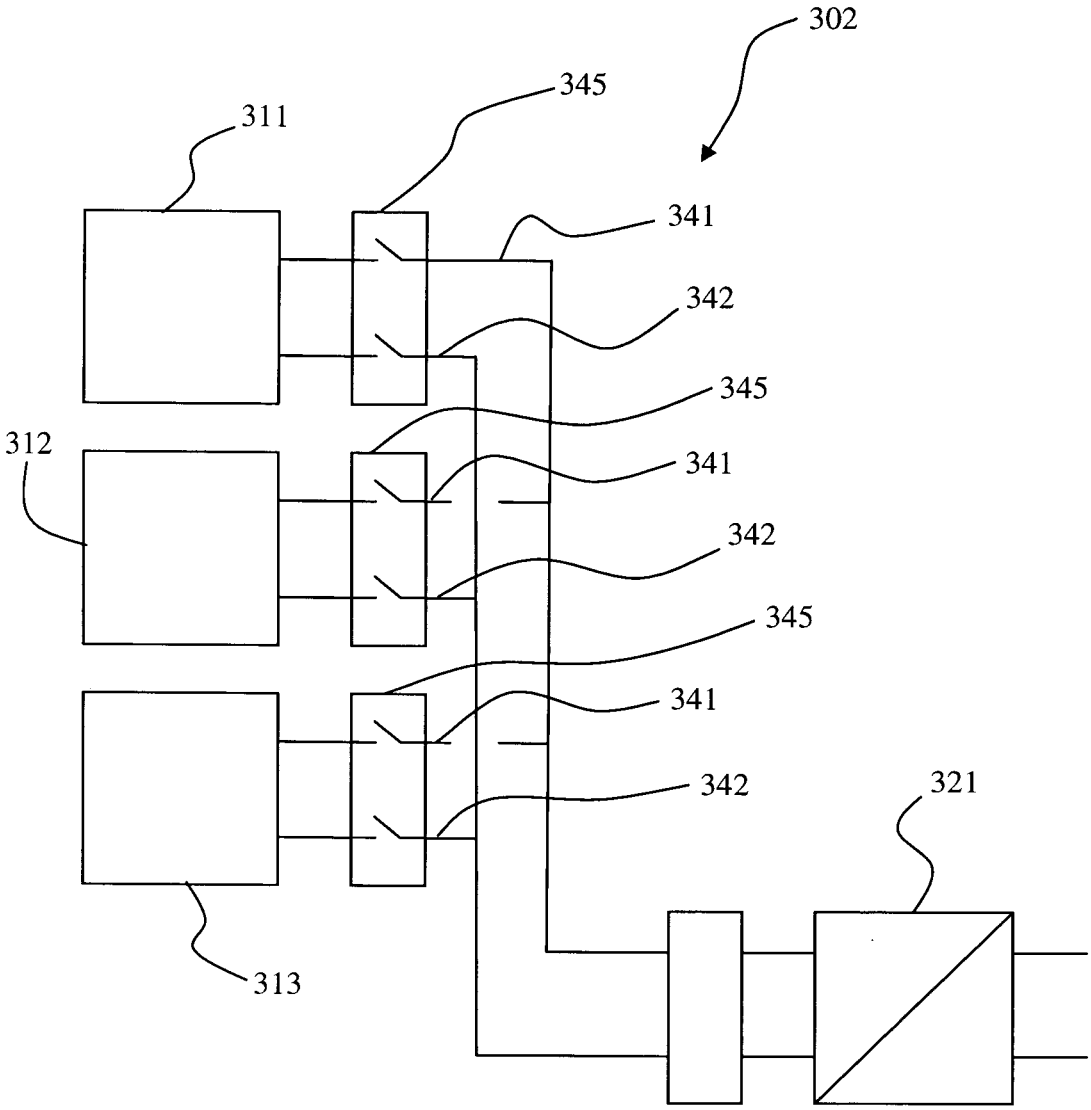
FIG. 11 represents an example of use of switchgear devices suitable for mounting in series on two electric lines of opposite polarities in another type of installation with photovoltaic cells.

The switchgear devices described above are perfectly suitable for photovoltaic cell installations. As represented in FIGS. 10 and 11, these installations 301, 302 are generally composed of several panels 311, 312, 313 integrating photovoltaic cells often connected in series and which generate a direct current. These panels are generally connected in parallel to the input of an inverter 321 performing conversion of the direct current into alternating current which will itself be redistributed to a main power system.

Installations of this type generally present a high voltage level, able to reach 1000 volts for example, and low short-circuit currents generally equal to about 1.25 times the rated current value of the installation. The lines of this type of installation generally present a time constant, i.e. an inductance over resistance ratio, that is often less than 2 milliseconds. In installations for which the number of panels in parallel is greater than or equal to 3, it is often necessary to fit suitable switchgear devices on the lines of each panel to break direct currents in high voltages.

These switchgear devices have to be able to break the current in both operating directions. In fact, in a first case, disconnection of a panel is sometimes necessary for maintenance reasons. In a second case, these switchgear devices can be used to protect the panels in case of malfunctioning. For example, in case of shadowing, a panel can behave as a receiver and generate a reverse current flow.

In installation 301 represented in FIG. 10, each panel is connected to inverter 321 by electric lines 331, 332, lines 332 being earthed. In this case, a two-pole switchgear device 335 comprising two modules and two separable contacts, such as the one represented in FIG. 1, was fitted on line 331 of each panel. Advantageously, it would have been possible to replace these switchgear devices 335 by four-pole devices, as represented in FIG. 9. This would enable the arcing voltage to be distributed over four modules instead of two.

In installation 302 represented in FIG. 11, each panel is connected to inverter 321 by electric lines 341, 342 forming an isolated power system. In this case, a two-pole switchgear device 345 comprising two modules and two separable contacts, such as the one represented in FIG. 7, was fitted on lines 341, 342 of each panel. Advantageously, these switchgear devices 345 could have been replaced by four-pole devices, as represented in FIG. 8. This would enable the arcing voltage to be distributed over two modules instead of one.

One advantage of the switchgear device according to the present invention is that it enables arc chutes to be implemented that have already been developed for breaking a mono-directional direct current.

The invention claimed is:

1. A switchgear device for breaking a direct current in at least one electric line whatever the direction of flow of current in said line, said device comprising:

at least two connection terminals, a predefined even number of separable contact pairs, each pair comprising two contacts each electrically connected to one of said connection terminals, but without any direct mechanical links between the contacts of each pair of contacts, a number of arc chutes equal to said predefined even number, each arc chute being associated with a distinct pair of separable contacts, each arc chute comprising an arc formation chamber, an arc extinguishing chamber, and permanent magnets presenting a polarity capable of moving an electric arc to said arc extinguishing chamber when a current in an at least one electric line is flowing in a predefined direction, and a number of tripping mechanisms equal to said predefined even number, each tripping mechanism being associated with one of said pairs of separable contacts for separating the separable contacts of said one pair in response to an electric fault in the at least one electric line, said tripping mechanisms being connected to one another by any mechanical link enabling said pairs of separable contacts to be opened simultaneously, wherein said device is of modular type and comprises a number of modules equal to said predefined even number, each module comprising a separate case, having:

one of said pairs of separable contacts, the arc chute associated with said one pair of separable contacts, the tripping mechanism associated with said pair of separable contacts, and a feeder terminal and an incomer terminal, each electrically connected, respectively, to one of said separable contacts.

2. The device according to claim 1, wherein the polarities of the magnets in the chutes are capable of causing the predefined current flow direction to be different for one half of the arc chutes.

3. The device according to claim 1, wherein the arc extinguishing chamber of each arc chute comprises a stack of deionizing plates.

4. The device according to claim 1, wherein each module is housed in a case comprising two parallel main panels, said modules being adjoined to one another via their main panels.

5. The device according to claim 4, wherein each pair of separable contacts comprises a movable contact for movement along an axis substantially parallel to the main panels.

6. The device according to claim 5, wherein the movable contacts of each pair of separable contacts are all arranged on the same side of said device.

7. The device according to claim 5, wherein the arc formation chamber of each arc chute comprises a first and second cheek extending parallel to the main panels of the modules, the permanent magnets of each arc chute being arranged behind at least the first cheek and presenting a polarity enabling generation of a magnetic field oriented in a direction substantially perpendicular to said main panels.

8. The device according to claim 7, wherein the arc formation chamber of each arc chute comprises:

an enhanced-induction section comprising a first part of the permanent magnets of said arc chute for generating a magnetic field thereby enabling an electric arc to be propelled, the first part of the permanent magnets comprising two magnetized fractions arranged behind each of the cheeks, and a diverting section comprising a second part of said permanent magnets for generating a magnetic field, on a longitudinal axis, that is substantially weaker than the field generated by the first part of the permanent magnets thereby enabling an electric arc to be diverted with respect to the longitudinal axis.

9. The device according to claim 1, wherein said switchgear device is for breaking on a single electric line, the connection terminals comprising a first feeder terminal and a first incomer terminal in series on said one electric line.

10. The device according to claim 9, wherein said device comprises at least two modules, wherein the first feeder terminal is the feeder terminal of a first module, and the first incomer terminal is the incomer terminal of a second module, the incomer terminal of the first module being connected to the feeder terminal of the second module.

11. The device according to claim 10, wherein the first feeder terminal and the first incomer terminal are arranged on the same side, and the permanent magnets of the arc chutes in the first and second module are capable of presenting identical polarities for generating magnetic fields oriented in the same direction.

12. The device according to claim 9, wherein said device comprises four modules, the incomer terminal of the first module being connected to the feeder terminal of a third module, the incomer terminal of said third module being connected to the feeder terminal of a fourth module, the incomer terminal of said fourth module being connected to the feeder terminal of the second module.

13. The device according to claim 1, wherein said switchgear device is for breaking direct currents on two electric lines, and the connection terminals comprise a first feeder terminal and a first incomer terminal for connection in series on one of said lines, and a second feeder terminal, and a second incomer terminal for connection in series on the other of said lines.

14. The device according to claim 13, wherein said device comprises only two modules, the first feeder terminal and the first incomer terminal being the feeder and incomer terminals of a first module, the second feeder terminal and the second incomer terminal being the feeder and incomer terminals of a second module.

15. The device according to claim 1, wherein the modules are inseparable.

16. An installation comprising at least one panel whereon photovoltaic cells are arranged, said panel for connection to two electric lines for supplying electric power in the form of direct current, wherein said installation also comprises at least one switchgear device according to claim 1 having at least two connection terminals for connection on at least one electric line.

17. A switchgear device having four modules and comprising a combination of two devices according to claim 8, each of said two devices for breaking a direct current on each of two electric lines, and the connection terminals of each of said two devices comprising a first feeder terminal and a first incomer terminal for connection in series on one of said lines, and a second feeder terminal, and a second incomer terminal for connection in series on the other of said lines.

* * * * *